US011674390B2

(12) United States Patent
Crompton et al.

(10) Patent No.: US 11,674,390 B2
(45) **Date of Patent: *Jun. 13, 2023**

(54) RESIN-GROUTED ROCK BOLT ASSEMBLY WITH AN ADAPTED SEALING BUSH

(71) Applicant: INNOVATIVE MINING PRODUCTS (PTY) LTD, Johannesburg (ZA)

(72) Inventors: Brendan Robert Crompton, Johannesburg (ZA); Martin Cawood, Johannesburg (ZA); Paolo Ettore Pastorino, Johannesburg (ZA); Rual Abreu, Johannesburg (ZA)

(73) Assignee: INNOVATIVE MINING PRODUCTS (PTY) LTD, Johannesburg (ZA)

( * ) Notice: Subject to any disclaimer, the term of this patent is extended or adjusted under 35 U.S.C. 154(b) by 0 days.

This patent is subject to a terminal disclaimer.

(21) Appl. No.: 17/393,153

(22) Filed: Aug. 3, 2021

(65) Prior Publication Data

US 2021/0381375 A1 Dec. 9, 2021

Related U.S. Application Data

(63) Continuation-in-part of application No. 17/419,533, filed as application No. PCT/ZA2020/050063 on Nov. 18, 2020.

(30) Foreign Application Priority Data

Nov. 22, 2019 (ZA) ..... 2019/07725

(51) Int. Cl.
*E21D 20/02* (2006.01)
*E21D 21/00* (2006.01)

(52) U.S. Cl.
CPC ..... *E21D 21/0033* (2013.01); *E21D 20/028* (2013.01)

(58) Field of Classification Search
CPC ..... E21D 20/00; E21D 20/02; E21D 20/021; E21D 20/025; E21D 20/028
See application file for complete search history.

(56) References Cited

U.S. PATENT DOCUMENTS 4,992,004 A * 2/1991 Haug ..... F16B 13/00 405/269
2003/0052153 A1* 3/2003 Peltonen ..... E21D 21/0026 228/33
2018/0291737 A1* 10/2018 Pastorino ..... E21D 20/028

FOREIGN PATENT DOCUMENTS

DE 10 2007 008966 A1 9/2007
DE 10 2008 006233 A1 7/2009
WO 2020/047562 A1 3/2020

OTHER PUBLICATIONS

International Search Report for PCT/ZA2020/050063, dated Mar. 15, 2021.

(Continued)

*Primary Examiner* — Janine M Kreck
(74) *Attorney, Agent, or Firm* — Nixon & Vanderhye

(57) ABSTRACT

Disclosed is a rock bolt assembly including: an elongate bolt extending with distal and proximal ends; a tubular sleeve longitudinally extending between leading and trailing ends on the bolt so at least a proximal end portion projects from the trailing end of the sleeve; and a nozzle docking bush on the proximal end portion between the sleeve's trailing end and the bolt's proximal end. The bush has a cylindrical body between first and second ends, a central hole extending through the body, spaced-apart annular ridges on the cylindrical body, a grout distributing channel between the ridges, and an aperture in the channel connecting the channel and hole. The central hole includes a leading portion ending at the first end, sealingly receiving the trailing end. A trailing portion of the central hole ends at the second end and (Continued)

sealingly engages the bolt. Each annular ridge seals against a grout nozzle.

19 Claims, 6 Drawing Sheets

(56) References Cited

OTHER PUBLICATIONS

Written Opinion of the ISA for PCT/ZA2020/050063, dated Mar. 15, 2021.

* cited by examiner

RESIN-GROUTED ROCK BOLT ASSEMBLY WITH AN ADAPTED SEALING BUSH

CROSS-REFERENCE TO RELATED APPLICATION

This application is a continuation-in-part of U.S. patent application Ser. No. 17/419,533 filed on Jun. 29, 2021, which is the national phase of PCT International Application No. PCT/ZA2020/050063 filed on Nov. 18, 2020, which claims priority to ZA Patent Application No. 2019/07725 filed on Nov. 22, 2019, the contents of which are hereby incorporated by reference.

BACKGROUND OF THE INVENTION

Field of the Invention

The invention relates to a rock bolt assembly adapted to be grouted into a rock hole and more specifically to an adapter type device that fits on the rock bolt to facilitate the sealing engagement of a nozzle of a grout delivery device with the rock bolt.

Description of the Related Art

Resin-grouted rock bolt assemblies are well known in the art. Such assemblies typically include a resin inlet adapter, or the like, which is engaged to a proximal end of a rock bolt, positioned to feed a resin into a resin conduit provided by a bore formed through the bolt or a sleeve or conduit which fits around the rock bolt, providing an annular conduit.

The adapter is adapted to receive a resin material from a grout delivery source and to channel the resin through the bore or the annular conduit.

The problem with such assemblies is at least two-fold. Either the adapter or the resin-tight seals, provided between the adapter and the bolt or the sleeve, are aligned in the line of action of the installation force. With respect to the adapter, this prevents a strong installation force being applied to the proximal end of the bolt, to avoid damage to the adapter, and with respect to the seals, this causes compressive damage to the seals.

Hereinafter, the term "grout" or "resin" is used interchangeably to mean any adhesive material which is introduced into the rock hole to adhere the rock bolt within the rock hole.

The invention at least partially sources the aforementioned problem.

SUMMARY OF INVENTION

The invention provides a rock bolt assembly which includes:

an elongate bolt which extends between a distal end and a proximal end;

a tubular sleeve which longitudinally extends between a leading end and a trailing end, on the bolt such that at least a proximal end portion of the bolt projects from the trailing end of the sleeve; and a nozzle docking bush on the proximal end portion between the trailing end of the sleeve and the proximal end of the bolt, the bush having a cylindrical body defined between a first end and a second end, a central hole formed through the body between the ends, a pair of spaced apart annular ridges on an outer surface of the cylindrical body, a grout distributing channel between the annular ridges, and an aperture in the channel which communicates the channel with the hole;

wherein the central hole includes a leading portion which ends at the first end and which is adapted to receive the trailing end of the sleeve in sealing engagement, and a trailing portion which ends at the second end and which is adapted to sealingly engage the bolt; and wherein each annular ridge is adapted to seal against a nozzle of a grout delivery system;

thereby to provide, on engagement of the nozzle with the bush, a sealed grout passage defined by the grout distributing channel, the aperture, the central hole and an interior of the sleeve.

The leading portion of the central hole may include a formation against which the trailing end of the sleeve is press-fitted in sealing engagement.

The formation may be an annular ridge or an annular recess.

The trailing portion of the central hole may be formed with threads to engage complementary threads on the proximal end portion of the bolt.

Alternatively, the trailing portion may be adapted to friction fit over the proximal end portion.

In either alternative, the second end of the bush may be positioned flush with the proximal end of the bolt. Preferably, the second end is fixed to the proximal end by any suitable method such as, for example, welding.

BRIEF DESCRIPTION OF THE DRAWINGS

The invention is further described by way of examples with reference to the accompanying drawings in which.

DESCRIPTION OF PREFERRED EMBODIMENTS

Figure 1:
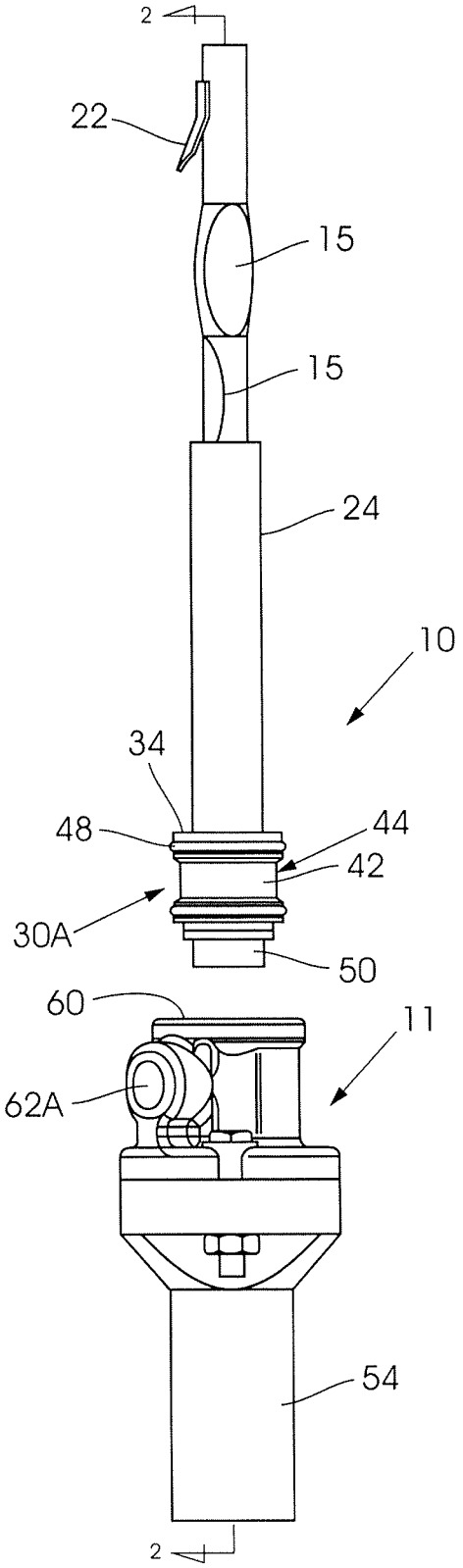
FIG. 1 is a view in elevation of a rock bolt assembly, in accordance with the invention, and a nozzle of a grout delivery system disengaged from the assembly.

Referring to FIGS. 1 to 4 of the accompanying drawings, a rock bolt assembly 10 is provided in accordance with the invention. The assembly is adapted to engage with a grout nozzle 11 at a leading end of a grout delivery system (not shown).

The assembly includes a rock bolt 12 having an elongate rod-like cylindrical body 14, which is adapted with paddle anchors 15, and which extends between a distal end 16 and a proximal end 18. In this example, the body has a threaded end section 20 which extends from the trailing end.

The assembly 10 includes an elongate sleeve 24 which extends between a leading end 26 and a trailing end 28. The sleeve is adapted to receive the rock bolt 12 with the distal and proximal ends (16, 18) of the bolt extending beyond the leading end and the trailing end (26, 28) respectively of the sleeve. The sleeve is held in position, on the bolt 12, at least by frictional abutment of the leading end with an adjacent paddle anchor 15, which anchor extends beyond the circumferential dimension of the bolt body 14.

Figure 5A:
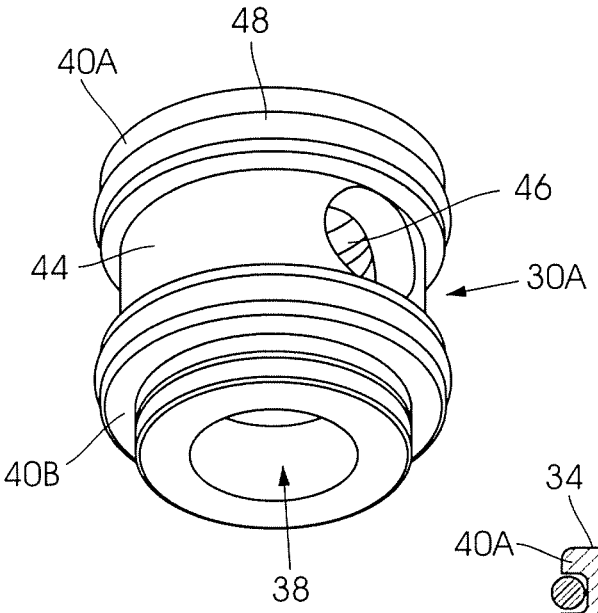
FIGS. 5A and 5B respectively illustrate, in perspective and in section respectively, a first embodiment of a nozzle docking bush of the invention.

The assembly 10 further includes a nozzle docking bush 30. This bush can be one of three embodiments of the bush, 30A, 30B or 30C, illustrated in FIGS. 5, 6 and 7 respectively, each being more fully described below. The bush of any of the embodiments has a unitary cylindrical body 32 made of a steel material, which is machined pressed or cast, or moulded from plastic or composite material.

With reference to FIGS. 1, 2, 5A and 5B, in describing bush 30A, the cylindrical body extends between a first end 34 and a second end 36, and has a central hole 38 which opens at each of these ends. The body has a pair of spaced apart annular ridges (respectively designated 40A and 40B) projecting from an outer cylindrical surface 42. Between the ridges, a circumferential grout distributing channel 44 is defined. Within the channel, the body 32 has an aperture 46 which is formed through a wall of the body, fluidly communicating the channel to the central hole 38.

Each annular ridge 40, in this non-limiting example, is adapted with a machined annular groove into which a respective O-ring seal 48 fits.

To engage the bush 30A to the rock bolt 12, the rock bolt body 14 is passed through the bush's central hole 38, proximal end 18 leading. A trailing portion 38.1 of the hole is circumferentially dimensioned with a small tolerance relatively to the bolt to fit over the bolt in tight fit.

A trailing end 28 portion of the sleeve 24 inserts into a leading portion 38.2 of the central hole 38, the trailing end coming to rest on a lip or step 49 protruding into the central hole 38.

To hold the bush in position, above the threaded section 20, with the trailing end 28 portion of the sleeve held within the central hole of the bush, a nut 50 is threaded onto the threaded section, behind the bush. The nut will move into contact with the trailing end 36 of the bush, forcing the bush against the sleeve which is prevented from moving up the bolt body 14 by abutment with the paddle 15.

Should the bolt 12 not be configured with paddles, as an alternative fixing means, the sleeve can be crimped, swaged or welded to the bolt body.

Figure 6:
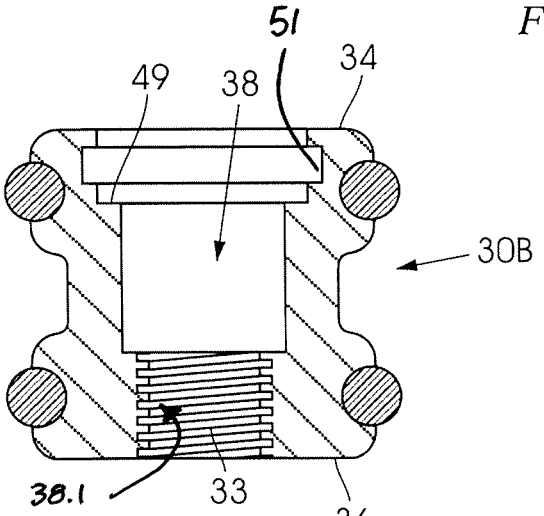
FIG. 6 illustrates a second embodiment of a nozzle docking bush of the invention.
Figure 8A:
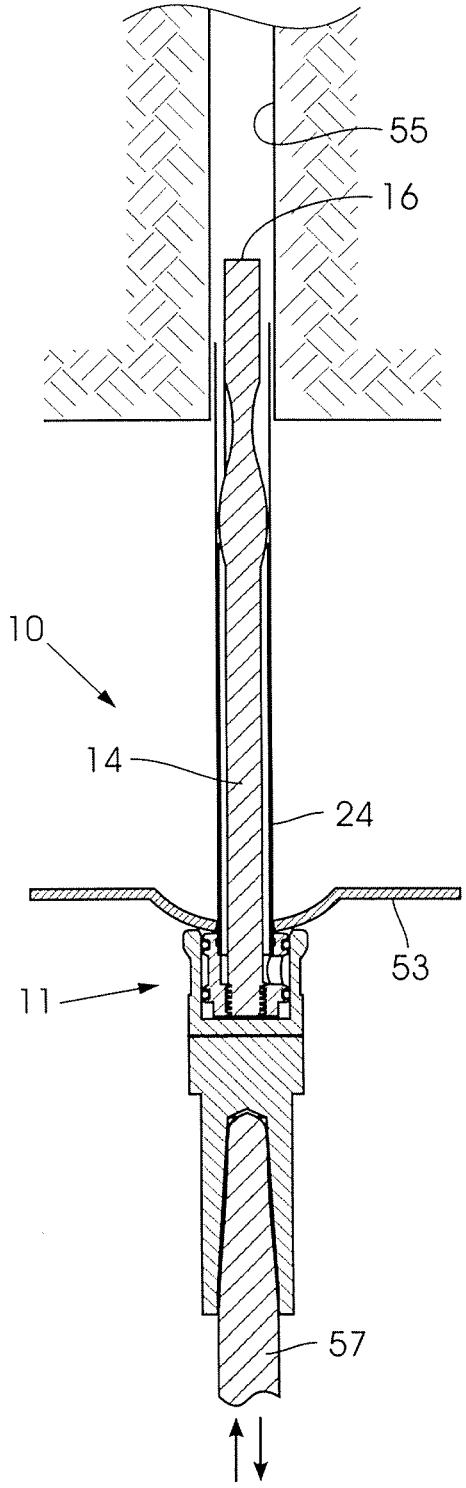
FIGS. 8A and 8B illustrate, in longitudinal section, the rock bolt assembly, with the nozzle in accordance with the second embodiment, being inserted into a rock hole.
Figure 8B:
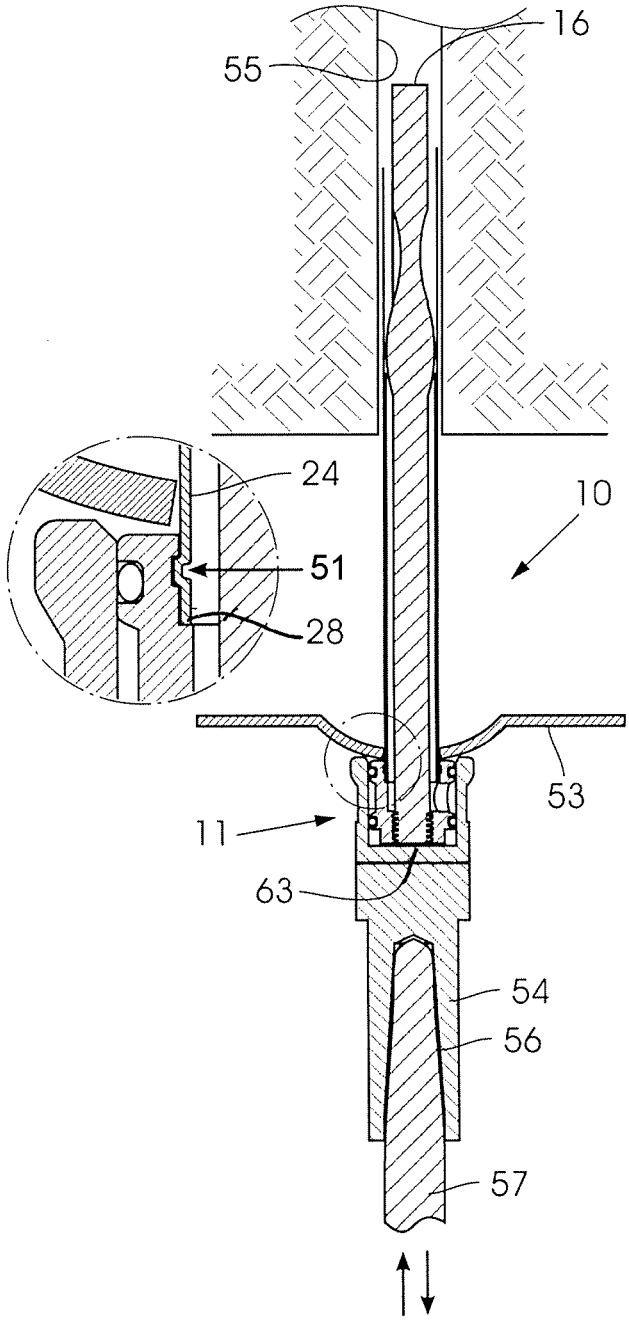

With reference to FIGS. 6, 8A and 8B, a second embodiment of the invention is described. In this embodiment, the body 14 of the bush 30B differs from bush 30A in that the trailing portion 38.1 of the hole 38 is formed with a female thread 33 (see FIG. 6). The thread provides a means by which the bush can be directly threadedly, and sealingly, engaged with the threaded section 20 of the rock bolt 12, without the need for a nut to secure the bush in place.

As with the earlier embodiment, the bush 30B is engaged fully on the bolt body 14, between the trailing end 28 of the sleeve 24 and the proximal end 18 of the bolt. The bush is positioned flush with the proximal end of the bolt thus providing a drive surface 35, which comprises the proximal end 18 of the bolt and the second end 36 of the bush, which is free from obstruction. This is particularly evident in FIG. 9.

Figure 9:
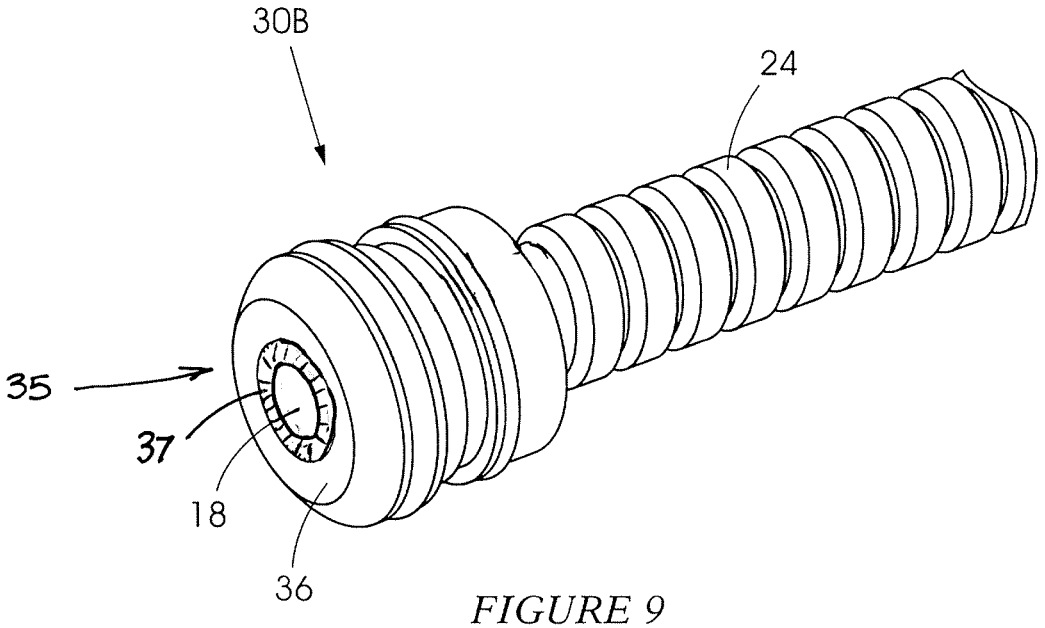
FIG. 9 is a view in perspective of a proximal end of the rock bolt assembly.

As illustrated in FIG. 9, the bush need not be fixed in position by means of the threads, but can have the trailing portion 38.1 of the hole dimensioned to friction fit over the bolt, as with embodiment 30A, and then welded in place along a weld line 37.

Figure 7A:
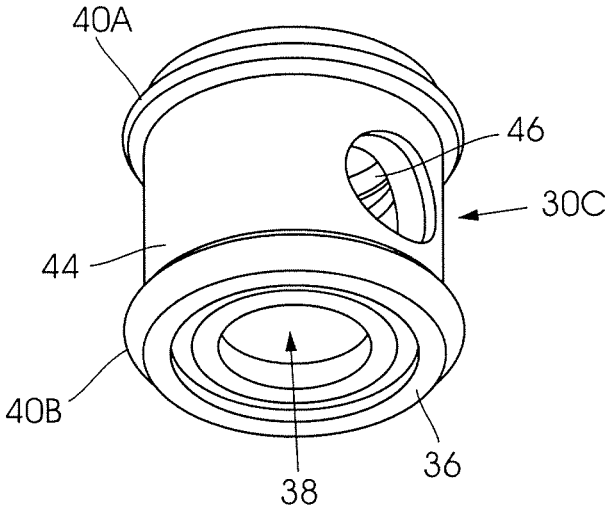
FIGS. 7A and 7B respectively illustrate, in perspective and in section respectively, a third embodiment of a nozzle docking bush of the invention.
Figure 7B:
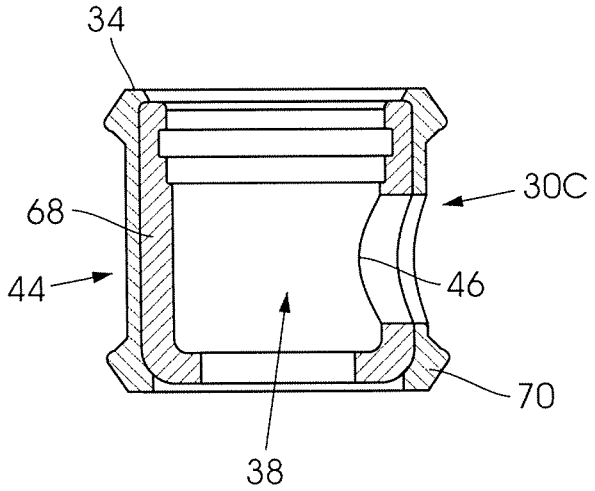

In another embodiment of invention, a bush 30C is provided which is illustrated in FIGS. 7A and 7B. In this embodiment, the body 32 is not unitary, as with the embodiment 30A, but rather is a composite body, having an inner component 68 made of a rigid material, for example a metal (steel) material, and an outer component 70 made of a resiliently deformable material, for example a plastic (polyurethane) material, which shrink wraps the inner component.

The pair of spaced apart annular ridges (40A and 40B) is integrally moulded as part of the outer component. As this component consists of a resiliently deformable material, there is no need to provide a separate sealing element as is the case with the earlier described embodiment. The sealing function is inherent in the configuration and material of manufacture.

Each embodiment of the bush (30A, 30B and 30C) includes a formation 51, which in this example is a recessed annular formation, formed in a wall of the leading portion 38.2 of the central hole 38. It is into this formation that the trailing end 28 portion of the sleeve 24 is press-fitted to ensure sealing engagement between the sleeve and the bush (see insert to FIG. 8B).

Figure 5B:
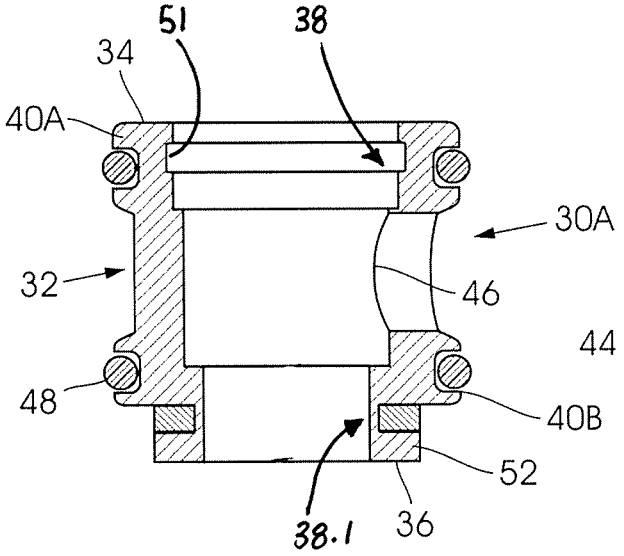

A load indicating formation 52 can be included as a separate element or made integral with the bush as illustrated, with respect to embodiment 30A, in FIG. 5B. This formation indicates when load on the barrel has reached a predetermined level.

Completing the assembly 10, a washer or faceplate 53 is located against the first end 34 of the bush body 32. This element is illustrated in FIGS. 8A and 8B.

The assembly 10 is designed to be mechanically inserted into a pre-drilled rock hole 55 with the aid of a drill rig (not shown). The drill rig can may have a plurality of actuator arms (not shown) on a carousel, one of which will include a drill, adapted to drill the hole, another, an insertion arm 57, will be adapted to aid in the insertion of the rock bolt assembly and thereafter to grout the inserted assembly in the hole. The insertion arm has, at a leading end, a tapered spigot (as with this example) or a threaded shaft. Alternatively the assembly may be manually loaded onto the drill rig before being mechanically inserted into a pre-drilled hole.

To aid in the installation and grouting steps of installation process, an adapter 54 is provided which has a tapered recess 56 into which the tapered spigot of the insertion arm 57 inserts. The grout nozzle 11 is attached to a free end 57 of the adapter. The grout nozzle has a cylindrical mouth 58 in a leading end 60 of the nozzle. A plurality of grout inlet ports (respectively designated 62A and 62B) open into the mouth. In the examples illustrated there are two ports with each port connecting to a respective supply conduit (not shown) carrying either a first or a second adhesive component of a resin. The ports deliver these components to the nozzle mouth.

It is anticipated that the resin components can be mixed prior to introduction to the rock bolt assembly 10 through the bush 30. In such case there will only be need for a single inlet port 62.

Figure 2:
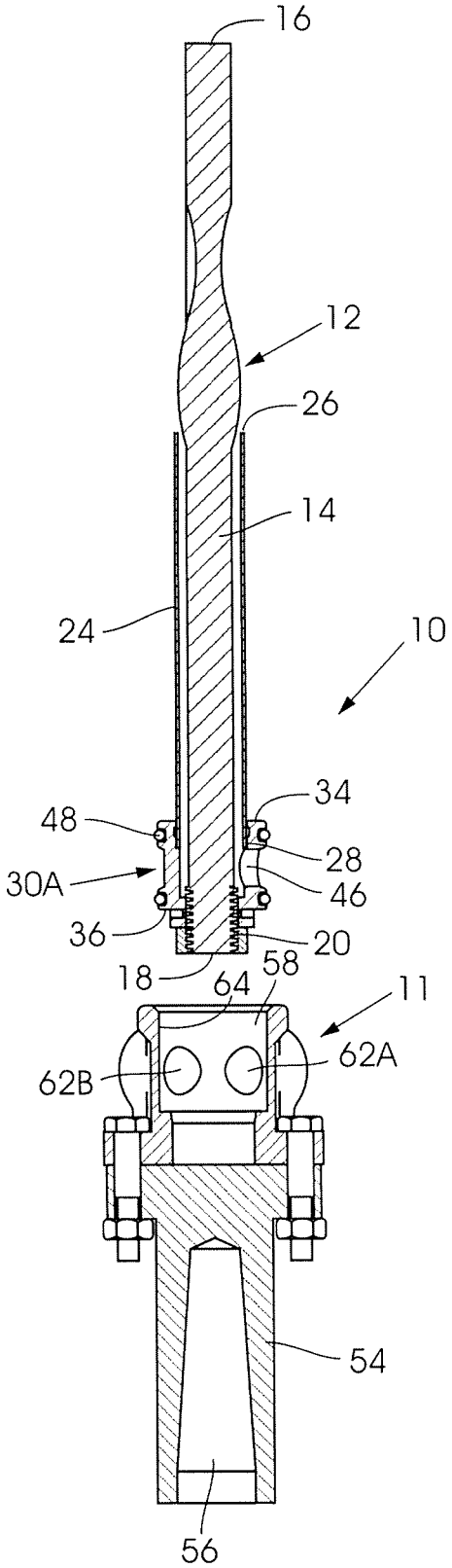
FIG. 2 is a view in longitudinal section of the rock bolt assembly and the nozzle of FIG. 1.
Figure 3:
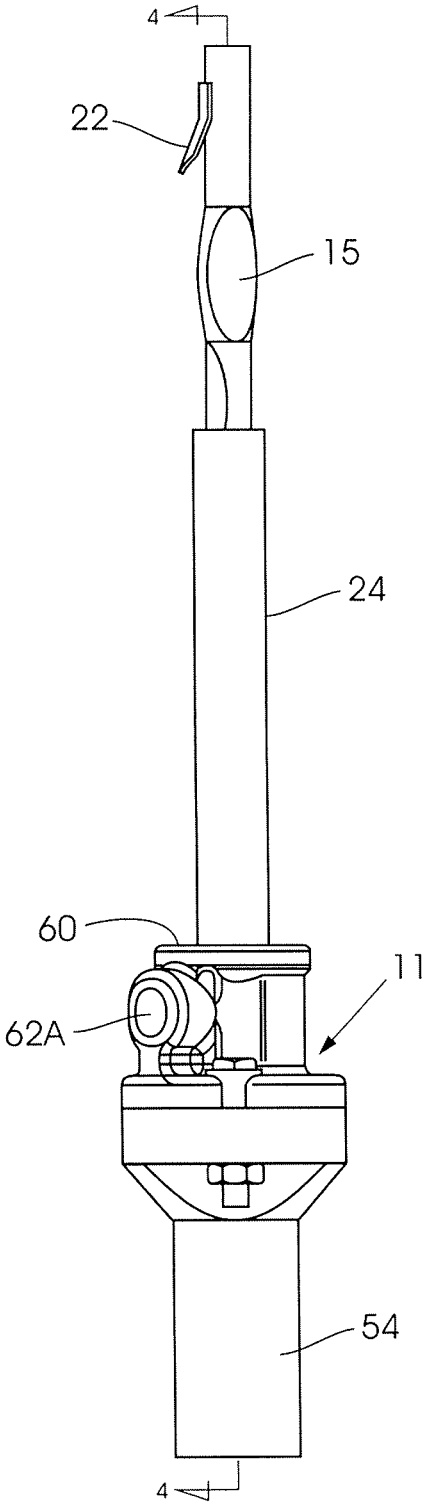
FIG. 3 is a view in elevation of the rock bolt assembly of FIG. 1 with the nozzle engaged with the assembly.
Figure 4:
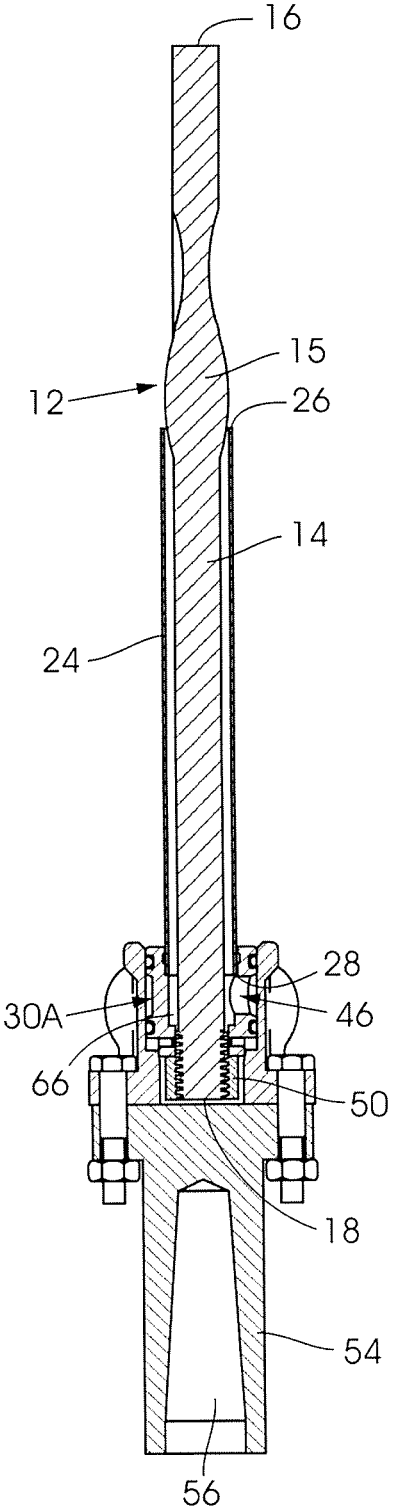
FIG. 4 is a view in longitudinal section of the rock bolt assembly and the nozzle of FIG. 3.

On installation, a proximal end 18 portion of the rock bolt assembly 10 carrying the bush 30B or the bush (30A, 30C) and nut 50, is received in the mouth 58 of the nozzle. This engagement is illustrated in FIG. 4 and FIG. 8B. The mouth 58 is dimensioned to receive the whole of the bush in snug fit. The seals (40 or 48) of the bush make sealing contact with an inner surface 64 of the mouth to seal the grout distributing channel 44 closed against this wall thus providing a sealed conduit into which the adhesive components are delivered from the respective ports 62. FIG. 2 illustrates these ports opening into the mouth which, when the bush is located therein, would be positioned coincident with the channel.

The assembly 10 then is brought into axial alignment with the pre-drilled rock hole, with the distal end 16 of the bolt leading. Now, to force the assembly into the hole, a force, which if required may be percussive (this percussive action is illustrated with directional arrows on FIGS. 8A and 8B), is applied by the drill rig, through insertion arm. The line of action of the force is in a direction axial to the assembly and is imposed on either the proximal end 18 of the bolt or the drive surface 35 of the assembly (depending upon the embodiment) by a floor 63 of the nozzle mouth 58. This percussive force incrementally drives the assembly into the rock bolt until fully inserted, with the faceplate 53 forced against the rock wall. The retaining element 22 holds the assembly in this fully inserted position within the rock hole, ready for grouting.

As mentioned, the adhesive components are introduced under pump action to the assembly via the ports 62 into the grout distributing channel 44 and, from there, through the aperture 46, into an annular space 66 between the bush 30 and the rock bolt 12, up through the interior of the sleeve 24 and finally into the rock hole 55. Along this course of flow, the adhesive components begin to turbulently mix and harden or, if the components are already mixed, merely to harden.

After grouting is completed, the arm 57 is withdrawn to remove the nozzle 11 from engagement with the rock bolt's proximal/projecting end 18. During the withdrawing action, the seals 48 act against the inner surface 64 of the mouth 58 to wipe this surface of residual resinous material which, if left, would harden and clog this part of the nozzle, not making possible imminent reuse.

The bush (30A, 30B or 30C) is a single-use item and therefore the hardening of residual resin within the distributing channel 44 or aperture 46 is of little consequence.

The axial force, applied to the assembly 10 at the proximal end 18 of the rock bolt 12, is highly energetic and will damage any grout-tight seal which is axially interposed between the bolt, the bush and the sleeve. It is for this reason that none of the junctions in the assembly that require to be sealed (i.e. the junction between the bush 30 and the nozzle mouth 58 or the junction between the bush and the sleeve) are aligned in the direction of this force. In particular, the sealed engagement of the bush with the sleeve, provided by press-fitting the sleeve into the recessed annular formation 51 of the bush, achieves a resilient grout-tight seal that is positioned lateral of the line of force.

The invention claimed is:

1. A rock bolt assembly which includes an elongate bolt which extends between a distal end and a proximal end, a tubular sleeve which longitudinally extends between a leading end and a trailing end, on the bolt such that at least a proximal end portion of the bolt projects from the trailing end of the sleeve, and a nozzle docking bush on the proximal end portion between the trailing end of the sleeve and the proximal end of the bolt, the bush having a cylindrical body defined between a first end and a second end, a central hole formed through the body between the ends, a pair of spaced apart annular ridges on an outer surface of the cylindrical body, a grout distributing channel between the annular ridges, and an aperture in the channel which communicates the channel with the hole, wherein the central hole includes a leading portion which ends at the first end and which is adapted to receive the trailing end of the sleeve in sealing engagement, and a trailing portion which ends at the second end and which is adapted to sealingly engage the bolt, and wherein each annular ridge is adapted to seal against a nozzle of a grout delivery system.

2. The rock bolt assembly according to claim 1, wherein the leading portion of the central hole includes a formation against which the trailing end of the sleeve is press-fitted in sealing engagement.

3. The rock bolt assembly according to claim 2, wherein the formation is an annular ridge or an annular recess.

4. The rock bolt assembly according to claim 3, wherein the trailing portion is formed with threads to engage complementary threads on the proximal end portion of the bolt.

5. The rock bolt assembly according to claim 4, wherein the second end of the bush is positioned flush with the proximal end of the bolt.

6. The rock bolt assembly according to claim 3, wherein the trailing portion is adapted to friction fit over the proximal end portion.

7. The rock bolt assembly according to claim 6, wherein the second end of the bush is positioned flush with the proximal end of the bolt.

8. The rock bolt assembly according to claim 3, wherein the second end of the bush is positioned flush with the proximal end of the bolt.

9. The rock bolt assembly according to claim 2, wherein the trailing portion is formed with threads to engage complementary threads on the proximal end portion of the bolt.

10. The rock bolt assembly according to claim 9, wherein the second end of the bush is positioned flush with the proximal end of the bolt.

11. The rock bolt assembly according to claim 2, wherein the trailing portion is adapted to friction fit over the proximal end portion.

12. The rock bolt assembly according to claim 11, wherein the second end of the bush is positioned flush with the proximal end of the bolt.

13. The rock bolt assembly according to claim 2, wherein the second end of the bush is positioned flush with the proximal end of the bolt.

14. The rock bolt assembly according to claim 1, wherein the trailing portion is formed with threads to engage complementary threads on the proximal end portion of the bolt.

15. The rock bolt assembly according to claim 14, wherein the second end of the bush is positioned flush with the proximal end of the bolt.

16. The rock bolt assembly according to claim 1, wherein the trailing portion is adapted to friction fit over the proximal end portion.

17. The rock bolt assembly according to claim 16, wherein the second end of the bush is positioned flush with the proximal end of the bolt.

18. The rock bolt assembly according to claim 1, wherein the second end of the bush is positioned flush with the proximal end of the bolt.

19. The rock bolt assembly according to claim 18, wherein the second end of the bush is fixed to the proximal end of the bolt.

* * * * *